United States Patent [19]

Schwartz et al.

[11] 4,250,701

[45] Feb. 17, 1981

[54] APPARATUS AND METHOD FOR MAKING LOOP CHENILLE TYPE YARN

[75] Inventors: Ira Schwartz, Villanova; William K. Wyatt, West Chester, both of Pa.

[73] Assignee: Techniservice Division, Textured Yarn Co., Inc., Kennett Square, Pa.

[21] Appl. No.: 938,425

[22] Filed: Aug. 31, 1978

[51] Int. Cl.[3] ..... D02G 3/34; D02G 3/36; D02G 3/42

[52] U.S. Cl. ..... 57/18; 57/6; 57/24; 57/207

[58] Field of Search ..... 57/6, 16–18, 57/90, 91, 206–208, 3, 24

[56] References Cited

U.S. PATENT DOCUMENTS

| | | | |
|---|---|---|---|
| 2,576,430 | 11/1951 | Weller | 57/24 |
| 3,041,812 | 7/1962 | Marshall | 57/6 |
| 3,362,146 | 1/1968 | Hortal | 57/24 |
| 3,439,484 | 4/1969 | Nalpas et al. | 57/16 |
| 3,626,679 | 12/1971 | Schwartz | 57/24 |
| 3,645,078 | 2/1972 | Roberts | 57/24 |
| 3,777,464 | 12/1973 | Gross | 57/24 |

FOREIGN PATENT DOCUMENTS

| | | |
|---|---|---|
| 619108 | 9/1935 | Fed. Rep. of Germany . |
| 693479 | 7/1940 | Fed. Rep. of Germany . |
| 812314 | 2/1937 | France . |
| 996029 | 8/1951 | France . |

*Primary Examiner*—John Petrakes
*Attorney, Agent, or Firm*—Miller & Prestia

[57] ABSTRACT

Apparatus and method for making loop chenille type yarns and yarns produced thereby are disclosed. An elongated spindle having a tapered needle surface at one end thereof is provided. The spindle has a passage therein in communication with the needle surface for feeding a core thread to the needle surface. Effect thread is overfed to the needle location where a nose piece member cooperating with the needle aids in wrapping the effect thread about the needle to form loops. The binder yarn is fed to the needle and twisted about the core and effect threads. In a preferred embodiment, means are provided for reciprocating the nose piece relative to the needle between effect thread loop forming and effect thread non-loop forming dispositions. In this manner, "thick" and "thin" novelty yarns are provided in which the thick sections of the yarn comprise looped effect threads whereas the loops are not provided in the thin yarn sections. Means may also be provided for twisting the effect thread about the binder and core threads. Further, by utilization of a novel lateral feed of the effect thread with respect to the needle surface, the effect thread is not twisted about the core thread, but rather is disposed in side by side adjacent relationship to the core with the binder being twisted about the core and effect thread.

22 Claims, 15 Drawing Figures

APPARATUS AND METHOD FOR MAKING LOOP CHENILLE TYPE YARN

BACKGROUND OF THE INVENTION

The present invention relates to an apparatus and method for producing a loop chenille type textile yarn or a "thick" and "thin" type of loop chenille novelty yarn and the yarns produced by said apparatus.

Many devices are known in the art which produce chenille by twisting an effect thread about a hollowed tapered spindle section as the core thread emerges from the interior passage of the spindle. Frequently, the twisted effect yarn is periodically sheared, forming what is referred to in the art as cut chenille. Oftentimes the cut chenille is plied with another yarn to ensure that the cut effect thread portions remain adhered to the yarn. One such device is shown in U.S. Pat. No. 3,626,679 (Schwartz).

Also, devices are known wherein loop chenille type yarns are produced by twisting one or more effect threads about a core thread or threads as the core exits from a hollow spindle or the like. In U.S. Pat. No. 3,439,484 (Nalpas et al) such an operation is effected followed by the additional twisting of a second effect thread about the core thread which has already been provided with one effect yarn looped therearound. Another similar device is shown in U.S. Pat. No. 3,041,812 (Marshall).

Despite the numerous advantages afforded by the above-mentioned prior art devices, there remains a need for a chenille apparatus of high speed and efficiency which is able to produce loop chenille type yarns of high quality and stability.

Further, a device which can produce novelty yarn wherein a portion of the yarn length comprises "thick" loop chenille sections which alternate with "thinner" non-looped sections is highly desirable. The "thick" and "thin" loop chenille yarn so produced has become increasingly popular for such end use applications as curtains and draperies.

These and other objects are met by the apparatus and novelty yarns produced thereby in accordance with the invention which will be further explained in conjunction with the following detailed description and appended drawings.

DRAWINGS

Figure 1:
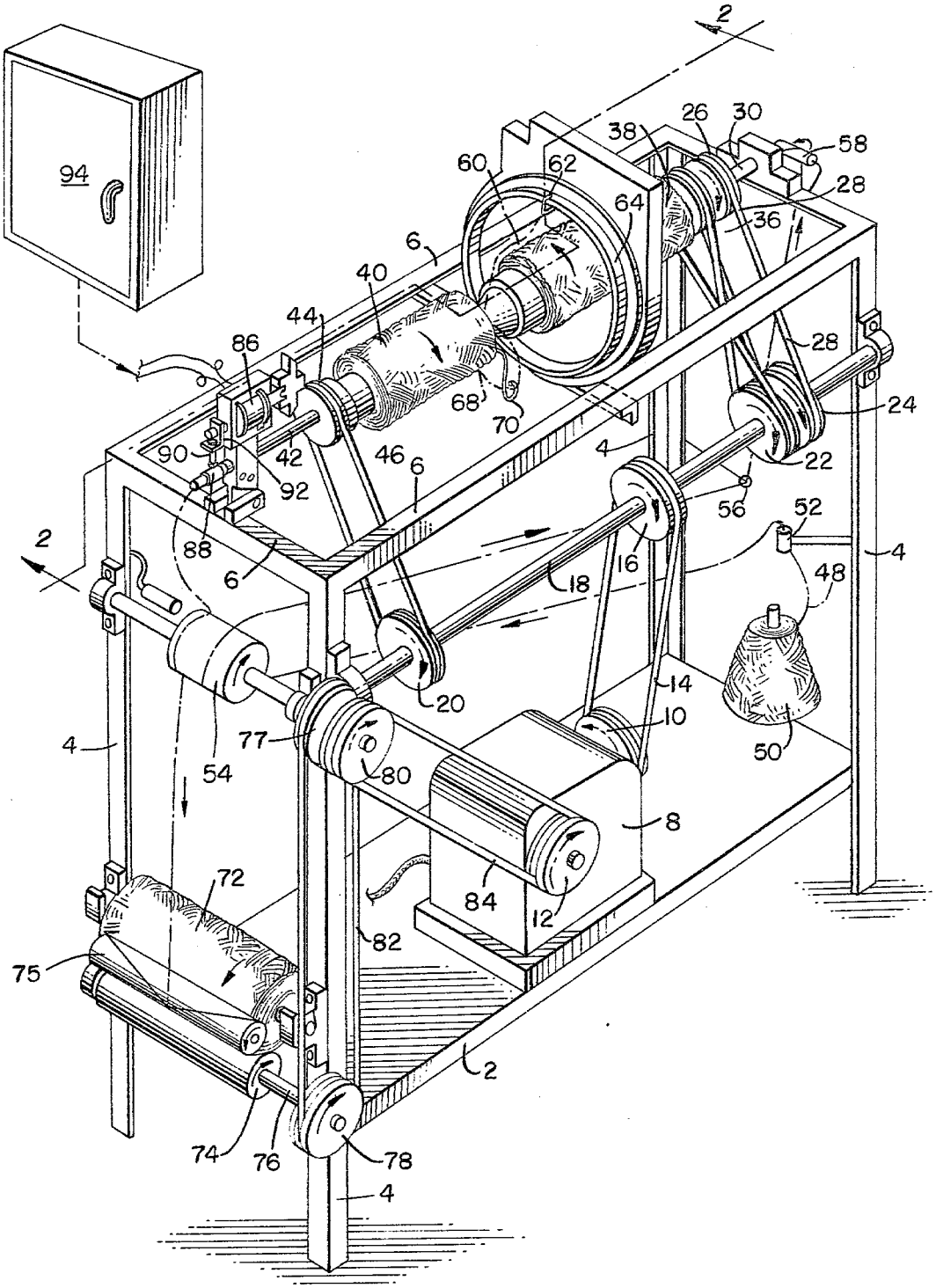
FIG. 1 is a perspective view of a loop chenille forming device in accordance with the invention.

The following description is not intended to limit the scope of the invention, as defined in the appended claims, but will be presented in specific terms in order to more clearly describe the construction and operation of the particular forms of the invention that have been selected for illustration in the drawings.

With reference to the drawings and especially to FIG. 1 thereof, there is shown one embodiment of the loop chenille apparatus which comprises table support 2 attached to vertical support legs 4. Horizontal supports 6 are welded to the vertical supports 4 to provide a support means for the device.

Electric motor 8 mounted on the table support 2 drives pulleys 10, 12. Trained about pulley 10 is belt 14 which is also trained about pulley 16 to turn horizontal drive shaft 18. Trained about pulleys 24, 26 is belt 28, which serves to drive spindle 30 and its associated tapered needle surface 32 in the direction indicated by the arrow in FIG. 1. Cross-belt 34 trained about pulley 22, 36 imparts rotation to effect thread package 38 which is mounted on spindle 30 to drive the effect package in the rotational direction indicated by the arrow thereon in FIG. 1.

Binder thread package 40 provided on hollow shaft 42 is driven in the opposite direction from that of the effect thread package 38 by the provision of pulleys 44, 20 and belt 46 trained thereon. The binder thread package is rotated in the same direction as is spindle 30.

Core thread 48 from package 50 is threaded through guide 52 and advanced by positively driven roller 54 through guide 56 and roller 58 and through the hollow interior of spindle 30. Effect thread 60 is taken from package 38 and drawn through traveller 62 which is rotatable about stationary ring 64 and is then drawn to needle surface 32. Binder thread 68 is threaded through flyer 70 and drawn to the area of needle surface 32 wherein the novelty yarn is prepared and withdrawn through shaft 42 by the action of the positively driven roller 54 about which the resultant novelty yarn is looped. The resultant yarn is then threaded through traverse roller 75 which is provided on a suitable shaft (not shown) and is fed to the nip of take-up drive roll 74 and take-up package 72. The drive roll 74 is in contact with take-up roll 72 and is mounted on horizontal shaft 76. The shaft 76 is driven by means of pulleys 77, 78, and belt 82 trained thereon. Drive for the pulley 77 is initiated by commonly shafted pulley 80 and pulley 12 with belt 84 trained thereon.

It is an advantageous aspect of the invention that the linear speed of the core yarn as it is presented to the needle surface 32 and the rate of withdrawal of the resultant yarn are accurately maintained at approximate equal rates due to the fact that both the core and resultant yarn are passed over the positively driven roller 54. This fact results in the production of a highly uniform resultant yarn. Of course, other feed and withdrawal arrangements can be produced by those skilled in the art. However, the arrangement shown herein in FIG. 1 is preferred.

Solenoid 86 is connected to shaft 42 by the provision of collar 88, post pin 90, and bracket 92. The solenoid acts as a means for actuating axial reciprocation of the shaft 42 along the common axes of the spindle 30 and shaft 42. The solenoid is electrically actuated by sequence controller 94 which is shown as a box in FIG. 1 but which will be explained in further detail hereinafter. As usual, solenoid 86 is provided with a spring (not shown) which functions to bias the shaft 42 in the right hand direction with respect to FIG. 1. This ensures that the tapered needle surface of the spindle will normally extend slightly into the nose piece so that the effect thread will form chenille loops about the needle. When the solenoid 86 is actuated, shaft 42 and associated nose piece 96 will be axially withdrawn toward the left hand side of FIG. 1. In this withdrawn position, chenille loops are not formed.

Figure 2:
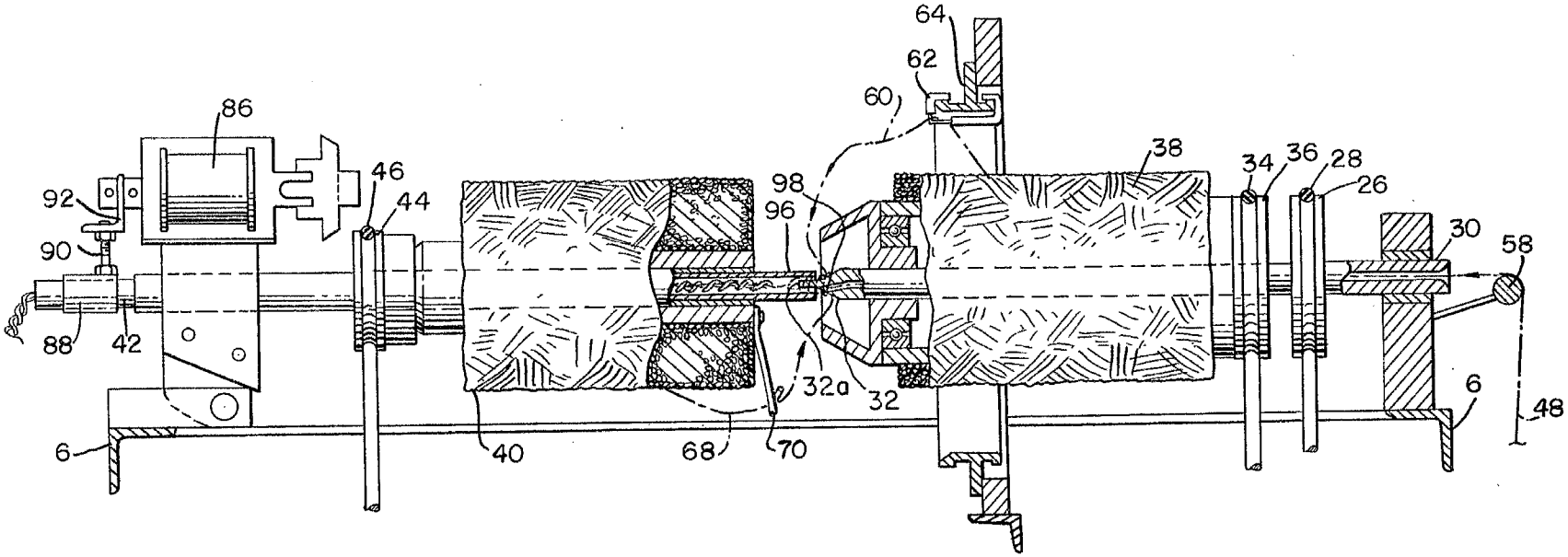
FIG. 2 is a side sectional view of the device shown in FIG. 1, taken along the lines and arrows 2—2 of FIG. 1, this Figure shows the device in operation with the needle surface and nose piece in their normal loop-forming disposition.
Figure 3:
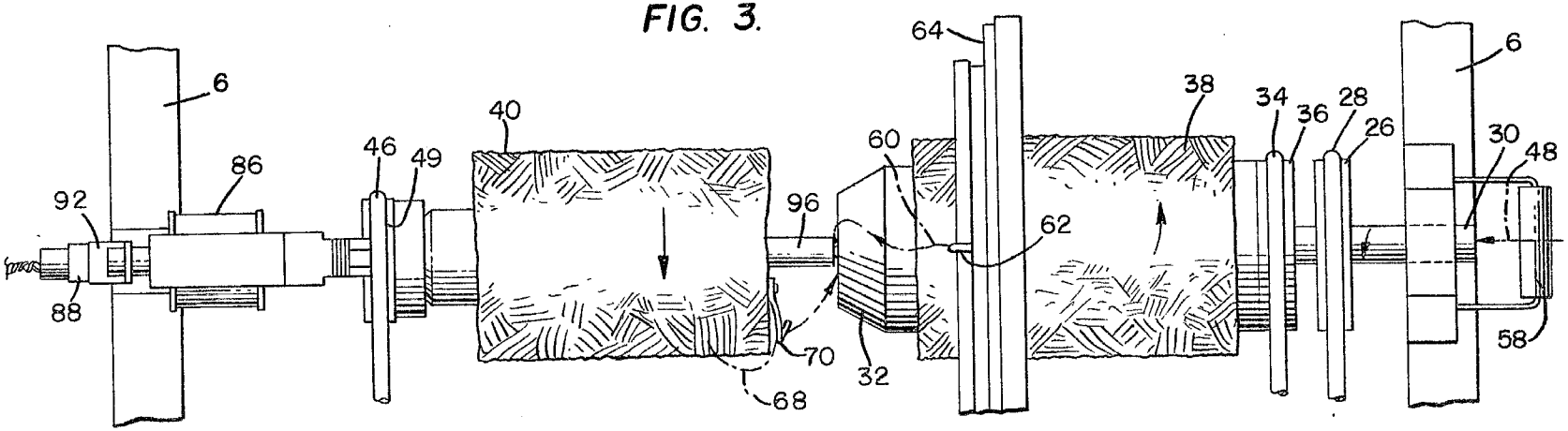
FIG. 3 is a view in plan of the device shown in FIG. 2.
Figure 5:
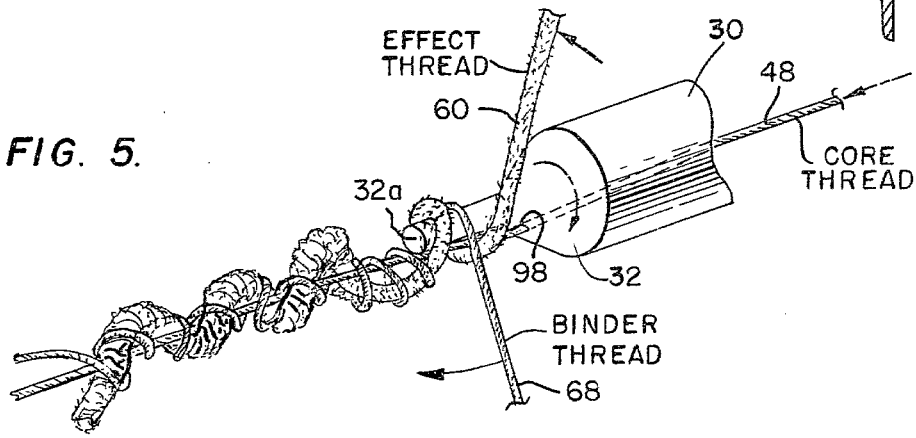
FIG. 5 is a perspective view of the needle and threads of the device shown in FIGS. 1–4 in the loop-forming disposition with the nose piece being omitted for better clarity.

Turning now to FIGS. 2 and 5, it can be seen that needle surface 32 is in the shape of a tapered frustum with the tip 32*a* of the taper extending within the coaxially aligned nose piece 96 of shaft 42 (FIG. 2). It will be appreciated that core thread 48 is threaded through aperture 98 of the frustum to be presented at tip 32*a* of needle surface 32. Effect thread 60 is fed under balloon tension to the needle surface at a rate greater than the core thread feed and bears against the surface of nose piece 96. The effect thread 60 is wrapped around needle surface tip 32*a* to form a loop. In this respect, it is to be noted that varying tensioning arrangements in association with the drawing of the effect thread 60 around the needle tip 32*a* result in the production of effect thread loops of varying diameters. Those skilled in the art will be able to vary the effect thread tension to vary loop size in accordance with their planned end use of the yarn.

Binder thread 68, rotating oppositely from effect thread 60, is confined in its path by the nosepiece 96 to be fed to the needle surface 32 and is wrapped about the effect and core threads to bind the effect thread in looped configuration to form the desired resultant loop chenille yarn. It is to be noted that the effect thread 60 itself is twisted about core 48 due to the action of the rotating effect package 38 and traveller 62. If desired, a flyer may be associated with the effect thread package instead of the ring and traveller combination. This rotation of the effect thread is in contrast with the action of the effect thread shown in the embodiment depicted in FIGS. 8 through 14, which embodiment will be explained in detail hereinafter.

The preferred feed rate for effect to core is approximately 2–4/1. In this respect, it is to be noted that the diameter of the needle tip 32*a* greatly affects the rate at which the effect thread is drawn thereto. To a minor degree the effect/core speed ratio is altered by the throughput speed of the resultant yarn. As stated, the withdrawal rate of the resultant yarn should be adjusted so that it is approximately equal to the core yarn feed rate.

Figure 4:
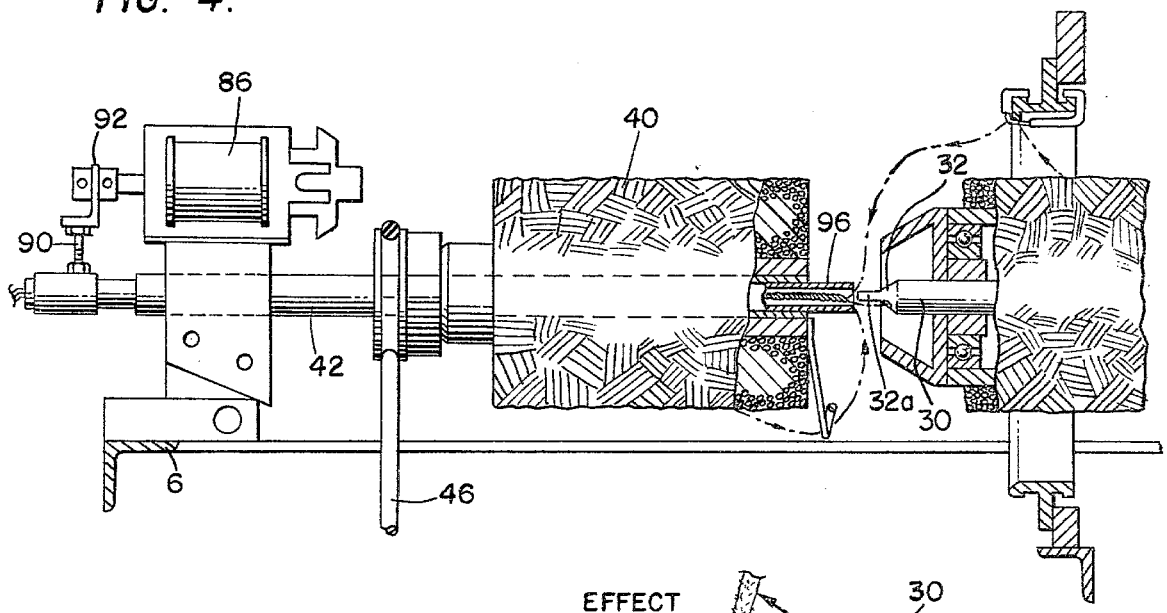
FIG. 4 is a side sectional view of the device shown in FIG. 1 similar to that shown in FIG. 2 with the exception that the nose piece is shown in its retracted non-loop forming position.
Figure 6:
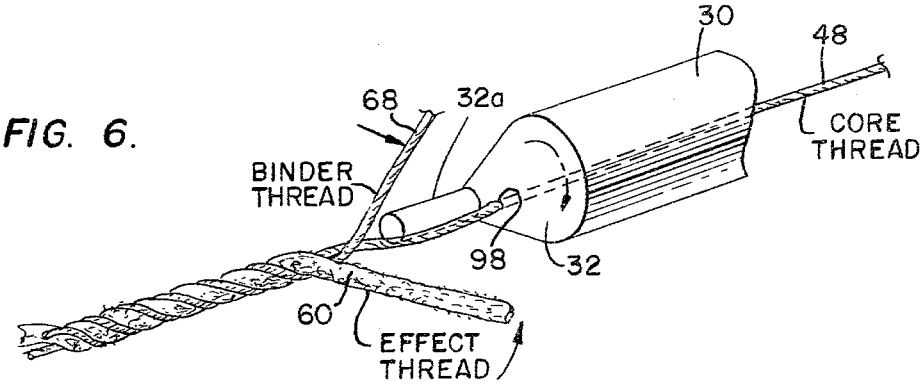
FIG. 6 is a perspective view of the needle and threads of the device shown in FIGS. 1–4 in the non-loop forming disposition with the nose piece being omitted for better clarity.
Figure 7:
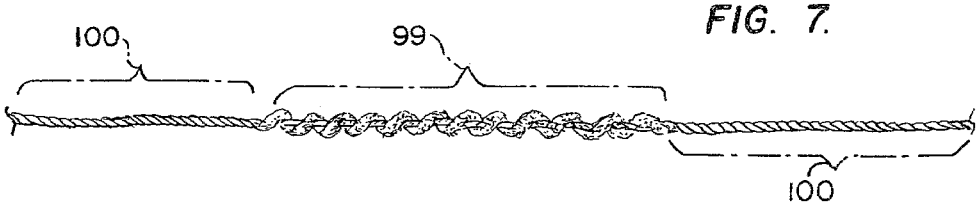
FIG. 7 is a side view of a "thick" and "thin" yarn in accordance with the invention produced by the machine embodiment shown in FIGS. 1–4.

Turning now to FIGS. 4 and 6, there is shown the relationship between needle surface 32*a* and nose piece 96 in those cases in which solenoid 86 has been actuated to retract shaft 42 toward the left hand side of the figure. In this case, tip 32*a* is spaced from the surface of nose piece 96. Accordingly binder thread 68 is not constrained to wrap around needle surface 32*a*, effect thread 60 will not be bound even if wrapped around tip 32*a*. Instead, thread 60 slides off tip 32*a* and is twisted about core 48 and the binder 68 is twisted about both the core and effect threads in a direction opposite to the effect thread twist direction. Positioning of shaft 42 and associated nose piece 96 in this manner thus leads to the formation of "thin" yarn wherein chenille loops are not formed. It will be appreciated that switching of the solenoid 86 between "off" and "on" positions during machine operation will result in yarn as shown in FIG. 7 wherein both thick chenille loop sections 99 and thin sections 100 are provided along the yarn length.

Turning now to FIGS. 8 through 14, there is shown another embodiment of a loop chenille device in accordance with the invention. In this device, rotation of an effect thread package is not necessary. Thus, relatively large effect packages may be stationed on a magazine or the like, thus saving machine down time due to frequent doffing of an effect thread package and also saving energy since rotation of the effect thread weight is not necessary.

In this embodiment, effect thread 60 from package 104 on creel 106 is threaded through air jet texturizing device 102 prior to being presented to needle surface 32. Of course, this side mount of the effect thread may also advantageously be combined with guidance of the yarn through other types of texturizing devices such as gear crimpers or false twisters, or the side mount may be utilized without any on the spot texturizing of the effect thread whatsoever. Further, it may be highly desirable to add some type of anti-slippage substance, such as a silicone colloid, to the effect thread prior to presentment of the effect thread to the needle to prevent slippage of the effect thread over the core thread. Of course, these anti-slippage substances may as well be added to either the core or binder threads also.

Figure 12:
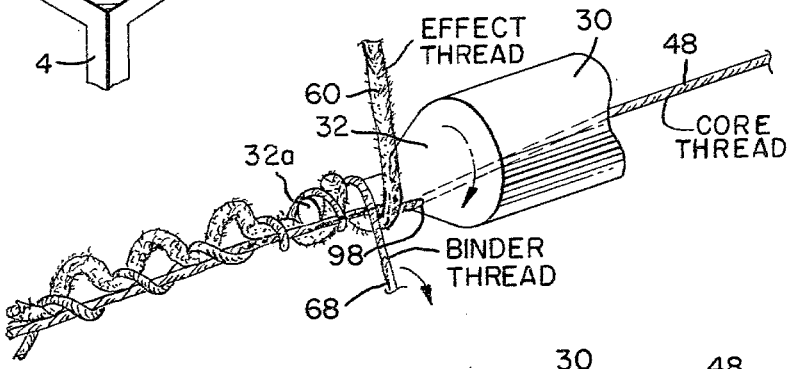
FIG. 12 is a perspective view of the needle and threads in the loop forming disposition in conjunction with the device shown in FIG. 8, the nose piece being omitted for better clarity.
Figure 9:
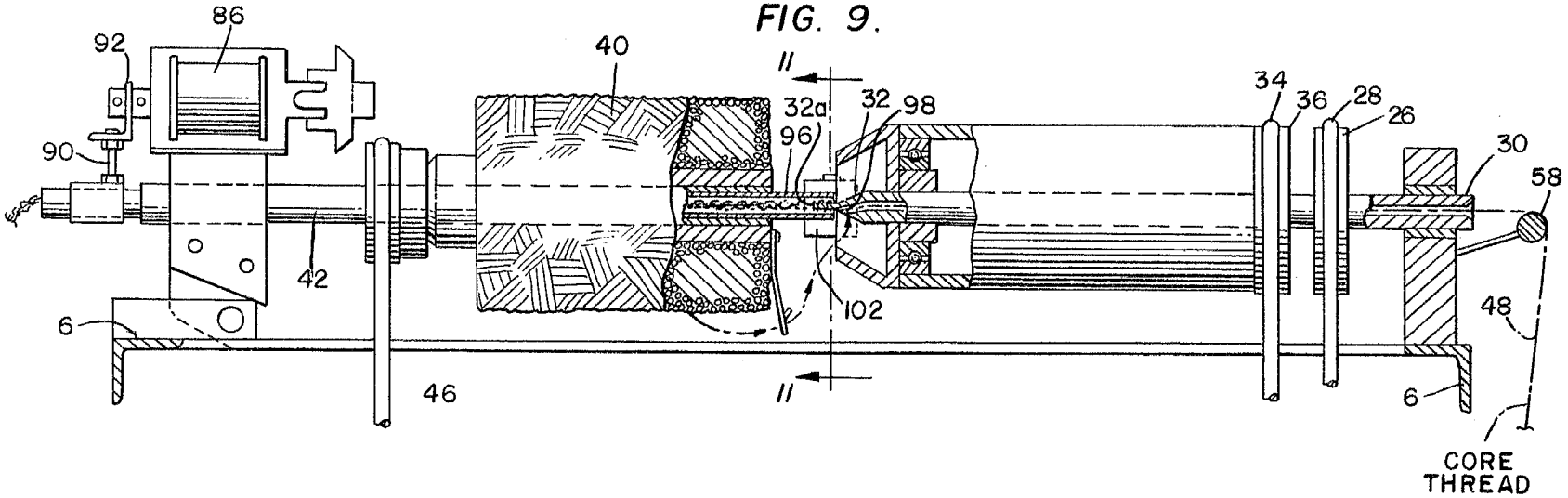
FIG. 9 is a side sectional view of the device shown in FIG. 8 taken along the lines and arrows 8—8 of FIG. 8, this view depicts the needle surface and nose piece in their normal loop forming disposition.
Figure 11:
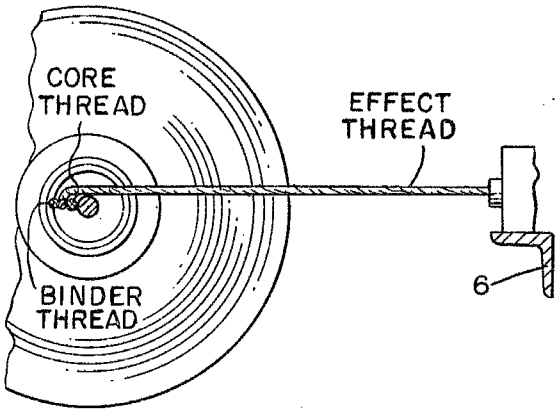
FIG. 11 is a sectional view taken along the lines and arrows 11—11 of FIG. 9.
Figure 10:
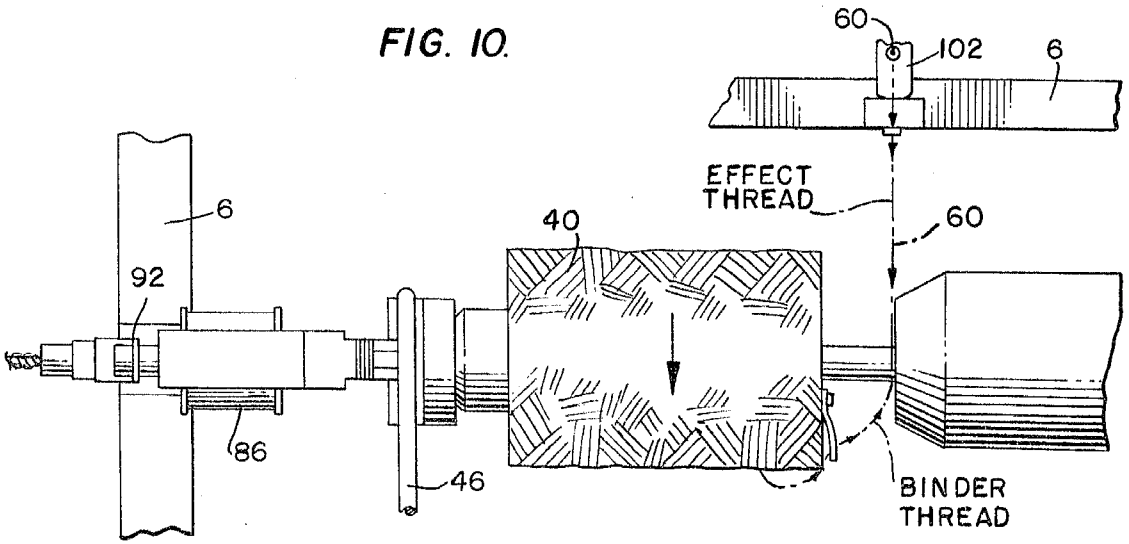
FIG. 10 is a plan view of a portion of the device shown in FIG. 9.

FIGS. 10 and 11 depict presentment of the effect thread to the needle surface 32 at an approximate 90° angle to the axes of shaft 42 and spindle 30. When the needle tip surface 32*a* is received in the nose piece 96 (as shown in FIG. 9), the effect thread is wrapped around the needle, and a false twist imparted to the effect and core threads by reason of the rotation of the needle surface 32 and the absence of twisting of the effect thread about the core thread. In this manner, a yarn is formed wherein the effect loops are in side by side adjacent relationship to the core thread. The effect thread 60 is not twisted about the core thread but is merely laid alongside of it. The chenille type loops may extend in countless radial positions along the axes of the core yarn. The binder thread is twisted around both the core and effect threads. This structural relationship is shown in FIG. 12.

Figure 13:
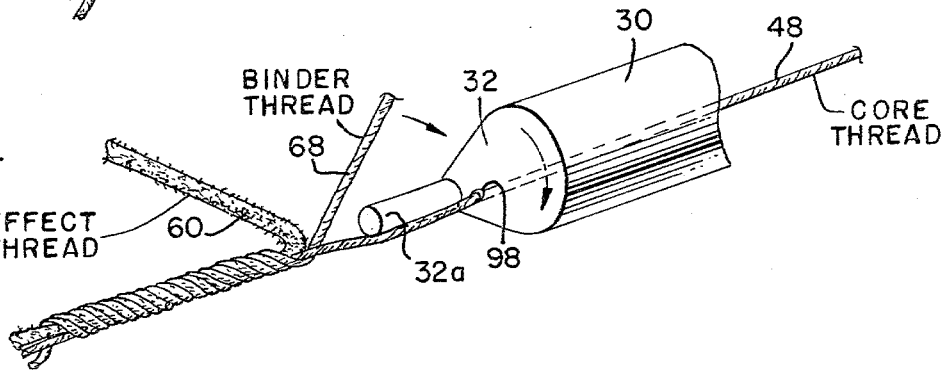
FIG. 13 is a perspective view of the needle and threads in the non-loop forming disposition in conjunction with the device shown in FIG. 8, the nose piece again being omitted for better clarity.

As shown in FIG. 13, in the instance when the nose piece 96 is retracted, the chenille type loops are not formed. Instead, the core thread 48 and the effect thread 60 run in side by side relationship along the yarn axis. The binder is twisted about the core and effect threads.

Figure 8:
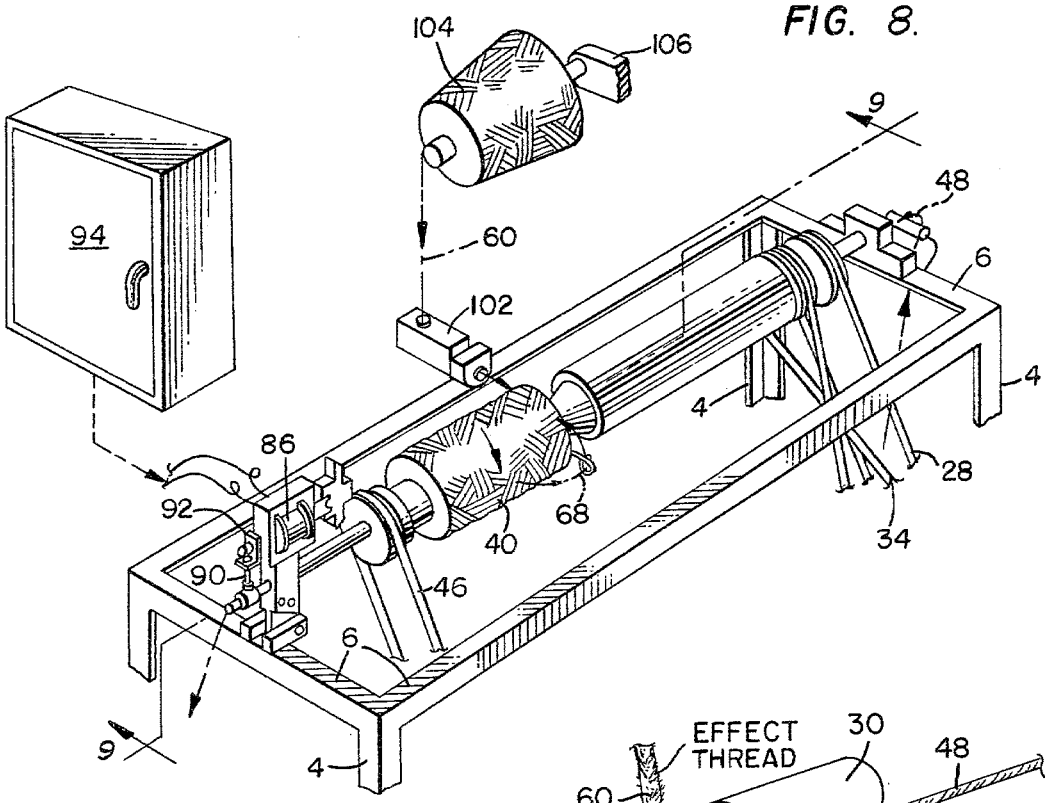
FIG. 8 is a perspective view of another machine embodiment of the invention, showing a lateral mount of the effect thread with respect to the needle surface and cooperating nose piece.
Figure 14:
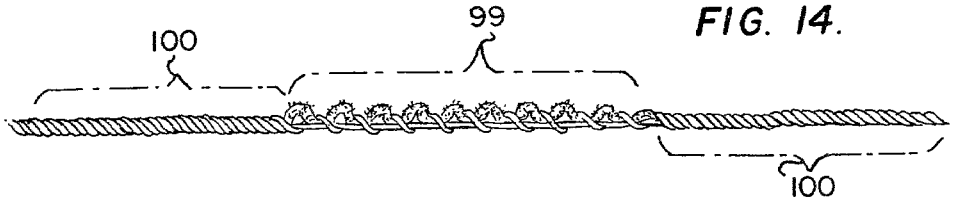
FIG. 14 is a side view of a "thick" and "thin" yarn produced on the machine embodiment shown in FIG. 8.

FIG. 14 shows a "thick" and "thin" yarn made by reciprocating the nose piece 96 in conjunction with the device shown in FIGS. 8 through 10. "Thick" portions 99 and "thin" portions 100 are alternately disposed along the yarn length.

Figure 15:
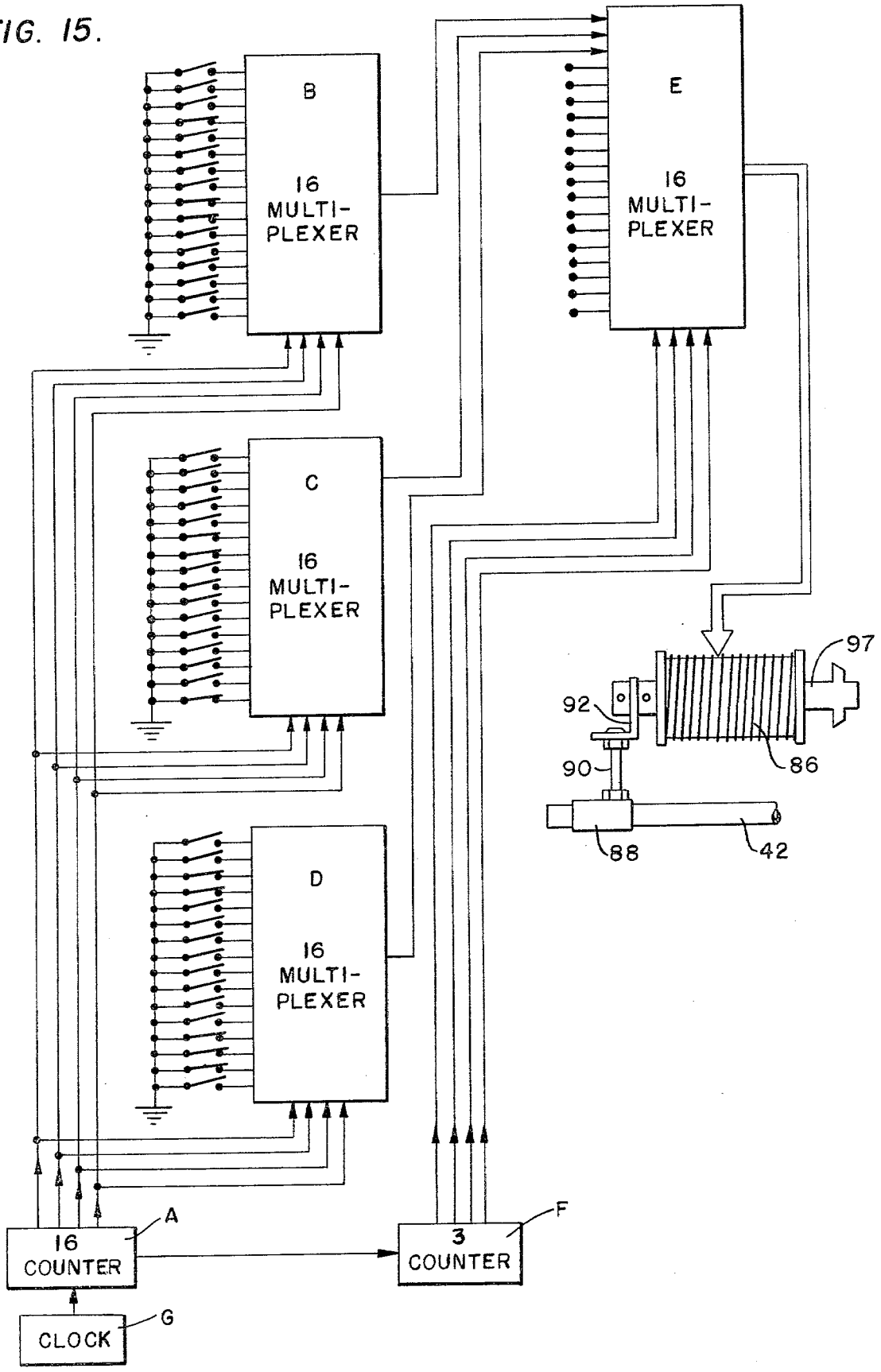
FIG. 15 is a circuit diagram of the sequence controller for electronically actuating retraction of the nose piece in accordance with the invention.

In FIG. 15, a digital logic diagram is shown for sequentially controlling electronic actuation means for the solenoid 86. The sequential control means utilizes a counter A to send binary coded signals from 0 to 15 to each of the three multiplexers B, C and D, which are connected to it in parallel. The sixteen switches on each multiplexer unit determine each multiplexer output sequentially as the counter counts from 0 to 15. The outputs from the three multiplexers are fed into a fourth multiplexer E, the output of which is determined by a second counter F. This second counter cycles from 0 to 2, and advances one count for each complete sixteen count cycle of the first counter A. Thus, although each of the first three multiplexers emits an output simultaneously, the final output to the solenoid 86 proceeds from them serially. The three sets of sixteen on-off switches on the first three multiplexers thus act as a single series of forty eight switches. A "thick" and "thin" pattern thus containing forth eight segments, each of which may contain "thick" (solenoid off) or "thin" (solenoid on) signals is thus formed. This sequence is particularly advantageous. A pattern developed through experimentation can be recorded as a series of discrete control switch settings for subsequent precise repeatability. The series of forty eight switches provides a "pictorial" representation of the pattern being selected, immeasurably aiding in developmental patterning. A desired overall "thick" - "thin" percentage balance may be maintained despite patterning changes by balancing the number of switch changes in each direction.

An adjustable clock input G is also electrically connected to counter A. This clock has 16 switch selectable discreet output speeds. Thus, the overall cycle length may be changed, while preserving the same relative pattern. This enables the user not only to vary the length of the overall pattern while retaining the proportional alternately "thick" and "thin" segment lengths intact, but also to maintain both absolute and relative lengths in the event of adjustments of core yarn linear speed.

When the solenoid 86 is actuated, it pulls shaft 42 toward the left hand side of FIG. 15 as the core rod 97 drives bracket 92 and in turn collar 88 fastened to shaft 42 toward the left hand direction.

Although this invention has been described in conjunction with certain specific forms and certain modifications thereof, it will be appreciated that a wide variety of other modifications can be made without departing from the true spirit of the invention. For instance, various drive means other than those shown can be utilized to achieve the purposes of the present invention. Also, other means for actuating reciprocation of the nose piece 96 and associated hollow shaft 42 may be utilized in accordance with the invention. Further, the use of varied tensions and tensioning devices in conjunction with any or all of the respective thread feeds may vary the overall novelty effect of the resultant yarn. The scope of the appended claims is intended to cover all such equivalent members and methods.

We claim:

1. Apparatus for fabricating novelty type yarn from a core thread source, an effect thread source, and a binder thread source, the apparatus comprising:

(a) a spindle having a needle surface at one end thereof, the spindle including a passage which serves as a path for the core thread, the passage being in communication with the needle surface so that core thread may be fed through the passage and presented along the needle surface;

(b) means for supplying effect thread to the needle surface at an overfeed rate with respect to the core thread;

(c) nose piece means coaxial with the needle surface, a portion of the needle normally extending into the nose piece means so that the effect thread may be looped around the needle surface to form loops of effect thread;

(d) means for supplying binder thread to the needle surface and for twisting the binder thread about the core and effect threads so as to form the desired resultant novelty yarn;

(e) take up means for withdrawing the resultant yarn from the needle surface.

2. Apparatus as recited in claim 1 further including means (f) for reciprocating the nose piece means (c) between two positions along the common axis of the spindle and the nose piece means (c), the first position corresponding to normal location of the nose piece means (c) adjacent the needle surface with a portion of the needle extending into the nose piece whereby loops of effect thread may be formed, the second position corresponding to retraction of the nose piece means (c) in spaced arrangement from the needle surface when loop formation of the effect thread is not desired.

3. Apparatus as recited in claim 2 wherein said means (f) comprises a solenoid.

4. Apparatus as recited in claim 2 further including sequential control means for operating electrical actuation of said means (f).

5. Apparatus as recited in claim 4 wherein said sequential control means comprise:

(i) a first counter means for emitting a predetermined number of binary coded signals, the sequential emission by said first counter means of its predetermined number of signals being a completed cycle;

(ii) a plurality of multiplexer units electrically connected in parallel to the output of said first counter means, each of said multiplexer units having a plurality of switching elements for determining each multiplexer unit output sequentially as the counter means counts emitting its predetermined number of signals;

(iii) an output multiplexer unit connected in parallel to the outputs of said plurality of multiplexer units, the output signal of said output multiplexer units operating said activating means;

(iv) a second counter means having its input electrically connected to said first counter means and its output to the output multiplexer unit for determining the output of said output multiplexer unit, said second counter means adapted to emit a predetermined number of binary coded signals equivalent to the number of multiplexer units in parallel with the first counter means, said second counter means advancing one count for each completed cycle of said first counter means, so that with the output signals of said plurality of multiplexer units being received simultaneously by said output multiplexer said output multiplexer can emit these signals serially to said actuating means.

6. Apparatus as recited in claim 5 wherein said actuating means is a solenoid.

7. Apparatus as recited in claim 5 wherein said first counter means is adapted to emit sixteen binary coded signals.

8. Apparatus as recited in claim 7 having three multiplexer units.

9. Apparatus as recited in claim 8 wherein each of said three multiplexer units has sixteen switching elements.

10. Apparatus as recited in claim 9 wherein said second counter means is adapted to emit three binary coded signals.

11. Apparatus as recited in claim 4 further comprising an adjustable clock means for inputting to said first counter means, thereby providing a variable dwell time of the first counter means cycle.

12. Apparatus as recited in claim 2 further including means for twisting the effect thread about the needle surface over the core thread.

13. Apparatus as recited in claim 12 wherein the twisting means comprise a stationary ring and a rotatable traveller tracked thereon.

14. Apparatus as recited in claim 13 wherein said means (b) comprises an effect thread package mounted on the spindle (a) and wherein the stationary ring is disposed about the effect yarn package in coaxial relationship with the spindle.

15. Apparatus as recited in claim 1 wherein the supply means (b) is located laterally with respect to the needle surface to supply the effect thread to the needle surface at an approximate right angle.

16. Method for producing a loop chenille type novelty yarn from core, effect, and binder threads, comprising:

(a) providing a tapered needle surface;

(b) providing a hollow nose piece member adjacent to and in coaxial alignment with the tapered needle surface so that a portion of the needle extends into the nose piece member to define an effect thread loop forming location;

(c) supplying a core thread alongside the needle surface;

(d) overfeeding effect thread to the needle surface and wrapping the effect thread about the needle surface to form loops, the effect thread being overfed with respect to the core thread;

(e) supplying binder thread to the needle surface and twisting it about the looped effect thread and the core thread at the needle surface to form the desired loop chenille yarn; and (f) withdrawing the loop chenille yarn from the needle surface.

17. Method as recited in claim 16 further including the step of twisting the effect thread about the core thread at the needle surface.

18. Method as recited in claim 17 wherein the step of twisting the effect thread about the core thread comprises threading the effect thread through a rotatable ring traveller.

19. Method as recited in claim 16 further comprising intermittently retracting the nose piece away from the needle surface to define an effect thread non-loop forming location to form yarn portions which are characterized by the absence of effect thread loops.

20. Method as recited in claim 19 further comprising controlling intermittent retraction of the nose piece by electronic sequential control of a solenoid attached to the nose piece.

21. Method as recited in claim 16 wherein said step (d) comprises supplying the effect thread to the needle surface at an approximate right angle to the axis of the needle.

22. Method as recited in claim 21 wherein step (d) comprises guiding the effect thread under the core thread and about the needle surface.

* * * * *